United States Patent [19]

Schaefer

[11] 4,031,994

[45] June 28, 1977

[54] DOUBLE TAB RACK FOR A TYPEWRITER

[75] Inventor: John O'Neil Schaefer, Lexington, Ky.

[73] Assignee: International Business Machines Corporation, Armonk, N.Y.

[22] Filed: Dec. 24, 1975

[21] Appl. No.: 644,256

[52] U.S. Cl. ..... 197/70; 197/91; 197/179

[51] Int. Cl.[2] ..... B41J 21/04

[58] Field of Search ..... 197/70, 91, 176, 177, 197/178, 179

[56] References Cited

UNITED STATES PATENTS

| | | | |
|---|---|---|---|
| 720,302 | 2/1903 | Webb | 197/70 X |
| 1,158,608 | 11/1915 | White | 197/70 |
| 1,158,609 | 11/1915 | White | 197/70 |
| 1,364,651 | 1/1921 | Stickney | 197/179 |
| 1,508,911 | 9/1924 | Aichele | 197/70 |
| 2,160,254 | 5/1939 | Smith | 197/70 X |
| 3,346,091 | 10/1967 | Cralle et al. | 197/176 |
| 3,540,565 | 11/1970 | Hanft et al. | 197/70 X |
| 3,893,561 | 7/1975 | Gibbons et al. | 197/91 |
| R23,834 | 6/1954 | Rainey | 197/70 |

*Primary Examiner*—Ernest T. Wright, Jr.
*Attorney, Agent, or Firm*—Laurence R. Letson

[57] ABSTRACT

A tab rack bar and tab stops are disclosed which provide for the ability to set a first set of tab stops on one side of the tab rack by displacing the tab stops into the path of the tabulator mechanism and then by rotating the tab rack set a second set of tab stops completely independent of the first set of tab stops by likewise displacing the tab stop into the path of the tabulator mechanism. The double tab rack and tab stops provides the capability of presetting and then selecting a first set of tab stops such as may be used for letter type correspondence and a second set of tab stops which may be used for columnar layout or statistical report typing, without having to clear and then reset the desired tab stops each time you care to switch.

8 Claims, 7 Drawing Figures

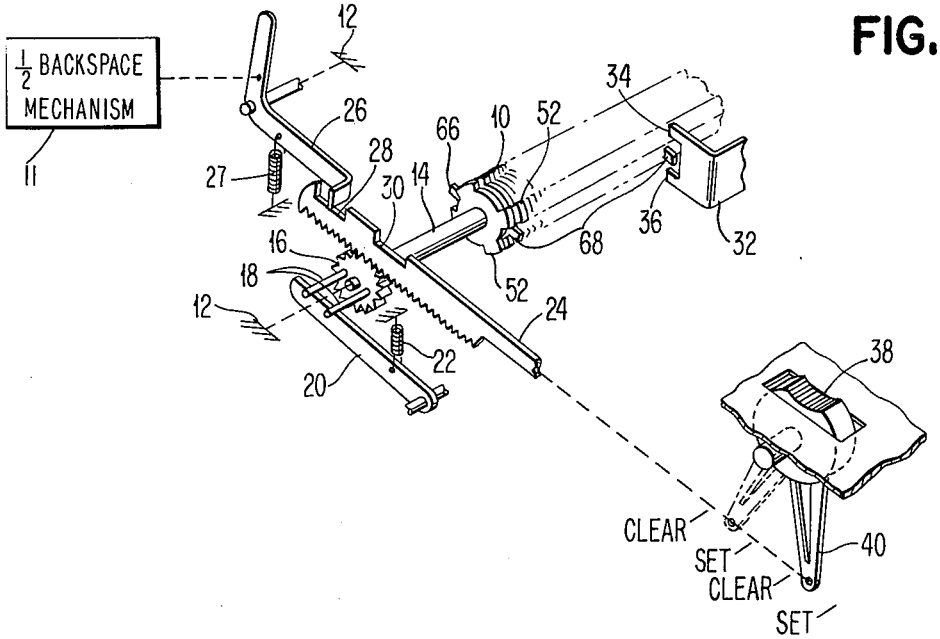
FIG. 1
FIG. 2
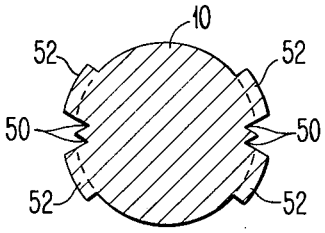
FIG. 3
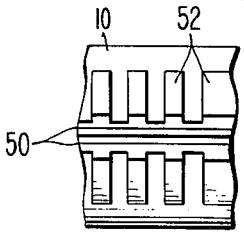
FIG. 4
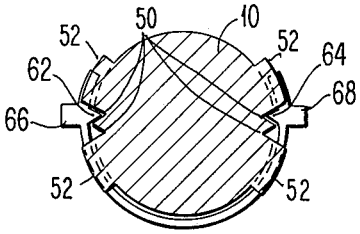
FIG. 5
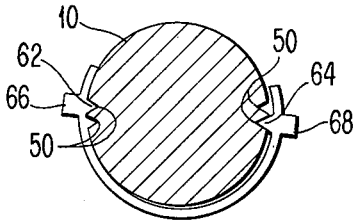
FIG. 6
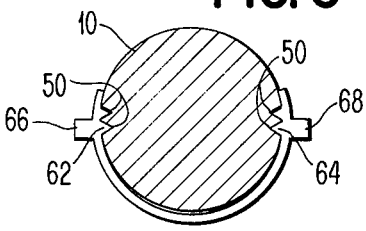
FIG. 7
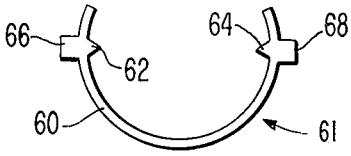

DOUBLE TAB RACK FOR A TYPEWRITER

BACKGROUND OF THE INVENTION

With the advent of typewriters which are more and more automated due to the advances in magentic media implementation such as magnetic tape typewriters or magnetic card control typewriters, and due to the advances in electronics, it is becoming more and more desirable to be able to use a typewriter fully, and to ease the typist's burden and the setting and resetting of tabulator stops for different purposes such as letter stops for correspondence and other spaced stops for columnar work such as statistical tables or reports. Heretofore the typist of necessity had to clear all existing tab stops and then reset the desired tab stops for the next typing assignment. Upon the completion of that assignment if the succeeding assignment required reversion to the original set of tab stops, then the existing stops had to be cleared and the original stop reset.

This consumed time and some typists attempt to avert this necessity by setting a combined set of tab stops and then attempting to ignore the ones not desired for that particular job. This approach tends to create the opportunity for errors in tabulation.

OBJECT OF THE INVENTION

The object of the invention is to accommodate two separate and discreet tabulator stop programs from a single set of tab stops capable of being set or cleared independently of the other.

An additional object of the invention is to improve the flexibility of the tabulator stop mechanism to accommodate more than one set of tab sensing surfaces from a single set of two stops.

The foregoing and other objects, features and advantages of the invention will be apparent from the following more particular description of a preferred embodiment of the invention, as illustrated in the accompanying drawing.

SUMMARY OF THE INVENTION

A tab stop rack is provided with double detent notches on one side of the support rod. This provides a detenting capability when a tab stop member is set or cleared, for holding the stops in their stable positions until physically moved to the opposite condition. The rod is also provided with an identical double set of detent notches on the opposite side of the rod. This provides for a second set of detenting positions for the opposite side of the tab member. The tab stop member is formed generally in the shape of an enclosing loop or arcuate shape preferably. It should be understood that other alternative shapes can be used so long as the function described is adequately performed. The material is configured of a substance which exhibits a resilience. The tap stop member has two detenting protrusions which may be engaged with one of the two detenting depressions on each side of the tab rack or tab rack rod. The tab stop member may be moved to engage the detenting protrusion on the tab stop into either the set or cleared positions on each side of the tab rack independently of whether the opposite side is in a set condition or cleared position. FIG. 1 illustrates an overall mechanism for the control of a dual tab rack.

DRAWING

FIG. 1 illustrates a rack change mechanism for controlling a dual tab rack.

FIG. 2 illustrates a cross-section of the tab rack in the form of an extruded rod.

FIG. 3 illustrates guide grooves formed into the extruded rod.

FIGS. 4, 5 and 6 show the different combinations of positions that the tab stop may assume on the tab rack.

FIG. 7 illustrates a typical tab stop member for insertion into the grooves on the tab rack rod.

DETAILED DESCRIPTION OF THE INVENTION

Referring to FIG. 1, there is illustrated a mechanism for the control of such a tab rack as is to be further described below. This particular apparatus is specifically adaptable to a single element printer or typewriter such as the IBM "Selectric" typewriter. The reason for the particular adaptability of this system to that typewriter is that the tab rack of that typewriter remains relatively fixed within the frame and does not translate as it would on a carriage type typewriter. The tab rack itself may be utilizable in a carriage type of environment, however, an alternate mechanism would be required for the rotation of the rack.

Tab rack 10 is supported within mounting frames 12 for rotation. On the shaft 14 of the tab rack 10 is fixedly attached a pinion 16. Pinion 16 may carry on it two pins 18 which will be further explained below. Spring biased against pins 18 is centering lever 20 which is controlled under the influence of spring 22. The pins 18 will engage a flat portion of lever 20 and the force of spring 22 acting through lever 20 will tend to detent or locate the two pins 18 in the same relative position with respect to other portions of the typewriter at any time that the tab rack 10 is not being forced from its at rest position. Engaging pinion 16 is rack 24 which may be used for several purposes. To prevent rack 24 from inadvertently moving at an undesired time, interlock 26 engages one of notches 28 or 30 formed into one of the surfaces of rack 24. Interlock 26 may be pivotally mounted on frame 12 for manual manipulation and biased to engagement with notches 28 or 30.

To affect the setting of tab stops 66, 68 on rack 10, set/clear member 32 is illustrated as adjacent rack 10. Set/clear member 32 will be carried on the carrier of the printer or typewriter thus incrementing along rack 10 as the carrier or printer translates.

Set/clear member 32 has two projecting tabs on its end denoted as 34 and 36. Tabs 34 and 36 cooperate to form a recess in the end through which the tab stops 66, 68 may pass relatively as set/clear member 32 translates past the tab rack 10.

Rack member 24, through a suitable connection of any one of several types, is operatively associated with a selection knob or control 38. Selection knob 38 may be positioned at any convenient location; for sake of illustration it may be placed upon the keyboard of the typewriter or printer. Selection knob 38 can be configured such that the connection between it and rack 24 is made through an extension arm or off center eccentric. Illustrated is extension arm 40. Extension arm 40 may be positioned by control knob 38 into either of the two positions illustrated in FIG. 1. When arm 40 is in the solid line position, it will cause the tabulation rack 10 to assume one orientation and when the arm 40 is shifted to be in the dashed line position, the movement of rack 24 in response thereto will cause the rotation of the tab rack 10 180° to position the second set of tab stops 66 in the operative position. Both positions illustrated for extension arm 40 are stable. An axis line extends outward from the connection point on arm 40 as a matter of reference. Illustrated on each side of the respective axis lines are two other reference marks indicating the position of that axis line for the clear and set movements which result from the rocking of the control knob 38 to cause either the clearing or the setting of a tab stop 68, as will be further discussed later. The rocking of the tab control knob 38 to cause a relatively short arcuate oscillation of tab rack 10 is of the same type that is presently used in the IBM "Selectric" typewriter to accomplish tab set and tab clear.

With a general understanding of the overall structure of the control mechanism, reference is now made to FIGS. 2 and 3. FIG. 2 shows a cross-section of the rod used as the tab rack 10. It may be extruded or machined as desired. The significant aspect of the shape is the detent notches 50. These detent notches 50 are in fact parallel grooves formed in the periphery of the extruded rod and extending the entire length of the rod. The external ridges 52 on the rod are extruded in solid form and may be subsequently machined or otherwise removed to form intermittent ridges 52 such as better illustrated in FIG. 3 which shows a view of the rod, detent grooves 50 and the interrupted ridges 52. The interrupted ridges 52 may also be generally described as guide lugs with the center line of the removed portion or gap corresponding in separation between adjacent center lines with the escapement increment of the typewriter. For example, a ten pitch escapement typewriter would have a .100 inch or 2.54 mm spacing therebetween while a twelve pitch typewriter would have a 0.083 inch or 2.12 mm spacing. The spacing for a dual pitch machine in a "Selectric" typewriter may be positioned such as described in U.S. Pat. No. 3,540,565 to Hanft, et al.

Referring to FIG. 7, an example of a tab stop member 61 for use on the tab rack 10 is illustrated. The tab stop member 61 illustrated in FIG. 7 is formed into a generally crescent shape with the crescent portion designated as 60. Formed into the interior of the crescent portion 60 are two protrusions 62 and 64. The protrusions 62 and 64 are generally illustrated as wedged shaped but may be any convenient shape which is complimentary to the shape of the detent notches 50 illustrated in FIG. 2.

On the exterior of the crescent portion 60 of the tab stop member 61, integral tab projections are formed to make tab stops 66 and 68. These stab stops 66, 68 are used for either setting or clearing the tab stops 66, 68 and are used to intercept the latch on the tabulator mechanism which may be found on the carrier of the single element printer. When one of the tab projections 66 or 68 are presented in the path of the tabulator mechanism on the carrier of the typewriter or printer, then the tabulator mechanism is tripped and the escapement pawl allowed to re-enter the escapement rack for further stepwise escapement in conventional manner.

The projection 66 or 68 is rocked either up or down by the set/clear movement of control knob 38, tabs 34, 36 of set/clear member 32 causes shifting of the detent protrusion 62, 64 into the other detent notch 50.

Referring to FIG. 4, it should be noted that protrusion 62 is in the uppermost detent notch 50 as viewed and the protrusion 64 is in the uppermost of its respective detent notches 50. Tab projection 68 is in what can be referred to as the set position. It should be noted that depending upon the configuration of the printer, the relative set and clear positions may be reversed. Inasmuch as projection 68 is in its set position, it will engage the tabulator latch member thus allowing the escapement pawl to re-enter the escapement rack at its appropriate location. Referring to FIG. 5, tab projection 68 is in its clear position in the lower of its two detented positions. It should be understood that with respect to projection 66 the projection 66 is inactive and has no effect on the tabulator mechanism of the carrier until rack 10 is rotated one half revolution by the mechanism disclosed in FIG. 1 or other similar device to present those projections 66 to the latch on the carrier. It can be clearly seen that since the projection 66 is detented in a position which will be below the center line or in the lower detent notch 50 when tab rack 10 is rotated to present tab projection 66 to the carrier, it is also in a cleared position. FIG. 6 illustrates both of the protrusions 62 and 64 in their lower notch 50 as illustrated. In summary, referring to FIG. 4, projection 68 is set while projection 66 is clear. FIG. 5 illustrates both projections 66 and 68 in the clear position and FIG. 6 illustrates projection 66 in the set position and projection 68 in the clear position.

The interrupted ridges 52 serve as guides and restraining members to prevent the tabulator stop member 61 and the cresent portion thereof 60 from translating axially on the tab rack 10.

It also serves to accurately position the tab stops 66, 68 so that the proper engagement between the escapement pawl and the escapement rack is accomlished upon re-entry.

As can be seen from the foregoing, one set of tab sensing surfaces may be set using projections 68, and for example might represent the tabulation stops normally required for correspondence, while a second set of tab sensing surfaces completely independent of the first set may be set using projections 66 to control the tabulator mechanism while typing columned report material. Since each tab stop member 61 is capable of representing two distinct tab commands, one in each of two exclusive tab sets, the ability to store two complete sets of tab stop commands is provided by this invention.

The shifting of the tab rack from one set of tabs to the other may be accomplished at the left margin to avoid interference between the tab projections 66, 68 with set clear tabs 34, 36. An alternative to this requirement is to connect lock lever 26 to the half backspace mechanism 11 which shifts the print carrier one half escapement increment leftward and unlocks rack 24. When this approach is used, the set/clear member 32 and its tabs 34, 36 pass between tab stops 66 or 68. Spring 27 biases interlock 26 into engagement with notches 28 or 30.

The one half backspace mechanism 11 may be one such as disclosed in U.S. Pat. No. 3,893,561.

While the invention has been particularly shown and described with reference to a preferred embodiment thereof, it will be understood by those skilled in the art that the foregoing and other changes in form and details may be made therein without departing from the spirit and scope of the invention.

I claim:

1. A tab rack assembly comprising a tab rack member and a plurality of tab stop members, each tab stop member representing an incremental escapement position of a printing mechanism relative to a record sheet, said tab rack member being movable to present alternatively one side thereof or the opposite side thereof to a tabulator control mechanism;

said tab stop members each having two active control projections extending therefrom for engagement by said tabulator control mechanism;

said control projections being opposite each other with respect to the axis of said tab rack member;

said tab stop member being configured to provide means for retention of each of said control projections in each of two positions respectively;

whereby two discreet and independent sets of tab commands may be set into and retained simultaneously in a tab rack member.

2. The tab rack assembly of claim 1 wherein said tab stop members are uniformly spaced along said tab rack member.

3. The tab rack assembly of claim 1 wherein said retention means is a bistable detent means.

4. The tab rack assembly of claim 1 wherein said tab rack member is rotatably mounted for rotation to present alternatively each set of control projections.

5. The tab rack assembly of claim 3 wherein said bistable detent means is comprised of protrusions on said tab stop member for engagement with recess surfaces on said tab rack member.

6. A tabular rack control mechanism comprising:

a tab rack assembly comprising a tab rack member and a plurality of tab stop members representing an incremental escapement position mounted on said tab rack member, and being movable to present alternatively one of a plurality of sets of tab sensing surfaces;

rotating means operatively connected to said tab rack assembly for causing said tab rack assembly to rotate to accomplish said presentation;

interlock means cooperatively engaged with said rotating means to prevent the rotation of said tab rack assembly except to engage said sensing surfaces with a set/clear member;

said interlock means operatively connected to means for preventing engagement of said sensing surfaces with said set/clear member.

7. The control mechanism of claim 6 wherein said means for preventing engagement is a mechanism for causing said set/clear member to backspace one half an escapement increment.

8. The mechanism of claim 6 wherein said interlock means may be disengaged from said rack rotation means at the left margin position of said set/clear member.

* * * * *